US006814244B1

(12) United States Patent
Hathcock

(10) Patent No.: US 6,814,244 B1
(45) Date of Patent: Nov. 9, 2004

(54) RAMPED LATCH CLOSURE SYSTEM

(75) Inventor: Mary H. Hathcock, New Bern, NC (US)

(73) Assignee: Chatsworth Products, Inc., Westlake Village, CA (US)

( * ) Notice: Subject to any disclaimer, the term of this patent is extended or adjusted under 35 U.S.C. 154(b) by 85 days.

(21) Appl. No.: 10/273,223

(22) Filed: Oct. 17, 2002

Related U.S. Application Data

(60) Provisional application No. 60/329,887, filed on Oct. 17, 2001.

(51) Int. Cl.[7] ..... A47F 5/00

(52) U.S. Cl. ..... 211/26; 312/265.1; 49/193; 292/163

(58) Field of Search ..... 211/26; 312/265.1, 312/265.4; 49/193; 292/169, 163, 207

(56) References Cited

U.S. PATENT DOCUMENTS 3,889,419 A * 6/1975 Maleck ..... 49/193
5,540,339 A * 7/1996 Lerman ..... 211/26
5,593,192 A * 1/1997 Stuchinsky ..... 292/163 X
5,675,934 A * 10/1997 Park ..... 49/193
5,829,197 A * 11/1998 Oh ..... 49/193
5,926,916 A * 7/1999 Lee et al. ..... 49/193 X
6,000,771 A * 12/1999 Wissinger et al. ..... 49/193
6,065,612 A * 5/2000 Rinderer ..... 211/26

* cited by examiner

*Primary Examiner*—Robert W. Gibson, Jr.
(74) *Attorney, Agent, or Firm*—Kennedy Covington Lobdell & Hickman, LLP

(57) ABSTRACT

A ramped latch closure system for securing a gate frame to a stationary frame assembly. The system includes a sill bracket and a pin assembly. The sill bracket includes a pin receptacle having an opening disposed at a first elevation for vertically receiving a pin, a first ramp extending from a second elevation to a third elevation, and a second ramp extending from a fourth elevation to a fifth elevation. The first ramp is vertically inclined toward the pin receptacle for gradually guiding a pin theretoward. At least one of the fourth and fifth elevations is separated from the first elevation in one vertical direction and the third elevation is separated from the first elevation in the opposite vertical direction. The pin assembly includes a pin and a spring for biasing the pin toward the pin receptacle.

43 Claims, 6 Drawing Sheets

RAMPED LATCH CLOSURE SYSTEM

CROSS-REFERENCE TO RELATED APPLICATION

This application is entitled to the benefit of, and claims priority to, provisional U.S. Patent Application Ser. No. 60/329,887 filed Oct. 17, 2001 and entitled "RAMPED LATCH CLOSURE SYSTEM," the entirety of which is hereby incorporated by reference.

BACKGROUND OF THE PRESENT INVENTION

1. Field of the Present Invention

The present invention relates generally to electrical component and equipment racks and, in particular, to latch mechanisms for securing swinging gate-type frames to the electrical component and equipment racks on which they are mounted, and methods of using same.

2. Background Art

Racks for supporting a wide variety of objects have been well known for decades. More recently, the advent of technological advances in audio and video equipment and in computer equipment has effected corresponding advances in the structures used to support and retain such electrical components. Thus, these support structures are now frequently constructed with space age materials using advanced techniques for providing strength, durability, flexibility and the like.

One particular focus in designing such racks is on the need to reliably support large amounts of weight thereon. The cumulative weight of electrical components, the wires and cables connected thereto, mounting accessories for supporting and retaining the components and wires, and any other electrical equipment, may be quite large, and thus, special consideration must be given to such racks and any portions thereof which may be required to support this weight. Many racks, frames or cabinets include portions which swing, slide or otherwise move relative to other portions. The problem of weight is particularly important with regard to those racks in which the moving portion must itself support a large amount of weight, thus heavily stressing the hinges, slides or other moving support mechanisms.

A good example of the issues surrounding this problem is demonstrated by those racks utilizing a "swinging gate" type of frame which is pivotably attached thereto using some sort of hinge mechanism. The rack may be floor-mounted or it may be wall-mounted. The gate frame may support some or all of the electrical equipment which is mounted in the rack, and thus the gate frame may be quite heavy. As a result, the hinge mechanism, and the structures of the gate frame and the rack in which it is mounted, must be able to withstand significant forces. In addition, the weight of the gate frame may cause the gate frame to become misaligned relative to the remainder of the rack, and thus it may become difficult to swing the gate frame back into a "closed" position within the rack. Further, it is often desirable to be able to open the gate frame from either side of the rack, and thus it is preferable to use a hinge mechanism which may also function as a latch.

One prior art solution to these problems utilizes a spring-loaded pin retained within a matching recess to act as a latch. Unfortunately, the pin must be manually moved against the pressure of the spring before the gate frame can be maneuvered into place, thus requiring intervention by the user and preventing the user from using both hands to maneuver the gate frame itself or the equipment mounted thereon. Thus, a need exists for a hinge-latch mechanism for a heavily-loaded gate frame which permits the gate frame to be easily closed merely by swinging the gate frame against the rack on which it is mounted without further intervention from a user.

SUMMARY OF THE PRESENT INVENTION

Briefly summarized, the present invention relates to a ramped latch closure system for securing a swinging gate-type frame to an electrical equipment rack. Broadly defined, a rack for supporting electrical equipment according to one aspect of the present invention includes: a stationary frame assembly having a front, a rear, a first side and a second side; a hinge assembly; a gate frame having a front, a rear, a first side and a second side, the first gate frame side being rotatably attached to the first side of the stationary frame assembly via the hinge assembly; and a sill bracket disposed in a corner of the second side of one of the gate frame and the stationary frame assembly, the sill bracket including a ramp leading to a pin receptacle.

In features of this aspect, the rack further includes a pin assembly, such that if the sill bracket is disposed in the gate frame, then the pin assembly is disposed on the stationary frame assembly, and if the sill bracket is disposed in the stationary frame assembly, then the pin assembly is disposed on the gate frame; the pin assembly includes a pin adapted to be received by the pin receptacle; the pin assembly includes a spring for biasing the pin toward the pin receptacle; the pin extends in a vertical direction, and the pin receptacle is oriented to receive a vertically-oriented pin; the gate frame is rotatably adjustable between a first position in which the pin is in contact with the ramp and a second position in which the pin is seated within the pin receptacle; the gate frame is rotatably adjustable between the first position and the second position without direct manual interaction with the pin; movement of the gate frame from the first position to the second position causes the pin to be temporarily vertically deflected by the ramp; the sill bracket is disposed in the lower corner of the second side of the stationary frame assembly, and the rack further includes a second sill bracket disposed in the upper corner of the second side of the stationary frame assembly; the sill brackets are of identical construction and are installed such that one sill bracket is rotated 90 degrees relative to the other, the sill bracket includes at least a first portion and a second portion, the two portions being diagonally symmetrical to each other; the ramp is a first ramp and is part of the first portion of the sill bracket, the second portion of the sill bracket includes a second ramp, and the first ramp and the second ramp are diagonally symmetrical; and the first portion of the sill bracket includes a first part of the pin receptacle and the second portion of the sill bracket includes a second part of the pin receptacle.

In other features of this aspect, the stationary frame assembly includes at least one side member and at least one bottom member, the side member is disposed on the second side of the stationary frame assembly, and the sill bracket is attached to both the side member and the bottom member; the gate frame includes at least one side member and at least one bottom member, the side member is disposed on the second side of the gate frame, and the sill bracket is attached to both the side member and the bottom member; the sill bracket is a first sill bracket and the pin assembly is a first pin assembly, wherein the hinge assembly includes a second sill bracket and a second pin assembly, wherein the second sill bracket includes a ramp leading to a pin receptacle, and wherein the second pin assembly includes a pin adapted to be received by the pin receptacle; when the pin of the first pin assembly is disposed within the pin receptacle of the first sill bracket, then the gate frame may be rotated relative to the stationary frame assembly via the first pin assembly and first sill bracket; and the first sill bracket and the first pin assembly are identical to the second sill bracket and the second pin assembly, respectively.

The present invention also includes a method for latching a first structure to a second structure, at least one of which is a gate frame, in an electrical equipment rack, the two structures being initially hinged together and a pin being disposed on the first structure and a ramped sill bracket having an inclined ramp and a pin receptacle is disposed on the second structure, wherein the method includes: rotating at least one of the two structures toward the other structure; during the rotating step, displacing the pin using the inclined ramp; and discontinuing the rotating step once the pin enters the pin receptacle.

In features of this aspect, the step of displacing the pin includes displacing the pin in a vertical direction; the method further includes biasing the pin in a direction opposite that of the displacement of the pin; the step of biasing the pin is carried out by a spring; a second pin is disposed on one of the two structures and a second ramped sill bracket having an inclined ramp and a pin receptacle is disposed on the other of the two structures, and the method further includes causing the second pin to be displaced by the second inclined ramp during the rotating step and discontinuing the rotating step once each of the pins has entered its respective pin receptacle; the ramped sill bracket further includes a second ramp, and the method further include contacting the first structure with the second ramp in order to guide the first and second structures together; the ramped sill bracket further includes a bearing surface disposed adjacent an end of the second ramp, and the method further includes the step of positioning the first structure relative to the second structure using the bearing surface; the method further includes guiding the first structure into contact with the bearing surface using the second ramp; and the rotating step is initiated by a user and the step of displacing the pin occurs without direct interaction between the user and the pin.

In another aspect of the present invention, a ramped latch closure system for securing a first structure to a second structure includes: a pin receptacle having an opening disposed at least partially at a first elevation for vertically receiving a pin; a first ramp vertically inclined toward the pin receptacle for gradually guiding a pin toward the pin receptacle, the first ramp extending from a second elevation to a third elevation, the portion of the first ramp disposed at the second elevation being generally adjacent the pin receptacle opening; and a second ramp extending from a fourth elevation to a fifth elevation, wherein at least one of the fourth and fifth elevations is separated from the first elevation in one vertical direction and wherein the third elevation is separated from the first elevation in the opposite vertical direction.

In features of this aspect, the fourth elevation is above the first elevation and the third elevation is below the first elevation; the system further includes a bearing surface disposed at the fourth elevation; the second ramp is vertically inclined toward the bearing surface; the fifth elevation is above the first elevation; at least one fourth of the pin receptacle opening lies in a horizontal plane; the second ramp is generally semi-conical in shape; the first ramp is generally planar in shape; the slope of the first ramp is substantially equal to the slope of the second ramp; the system further includes a third ramp, the first and third ramps being diagonally symmetrical; the system further includes a fourth ramp, the second and fourth ramps being diagonally symmetrical; the system further includes a pin assembly; the pin assembly includes a pin of suitable size and shape for vertical insertion into the pin receptacle; the pin is vertically adjustable relative to the first ramp; and the pin is disposed to contact the first ramp when the pin assembly and the first ramp are moved toward each other.

In yet another aspect of the present invention, a rack for supporting electrical components includes: a stationary frame assembly having a front, a rear, a first side and a second side, the second side having a top corner and a bottom corner; a gate frame having a front, a rear, a first side and a second side, the first side of the gate frame being rotatably attached to the first side of the stationary frame assembly, and the second side of the gate frame having a top corner and a bottom corner; a first sill bracket disposed in the bottom corner of the second side of the stationary frame assembly, the sill bracket including a ramp leading to a pin receptacle; a second sill bracket disposed in the top corner of the second side of the stationary frame assembly, the sill bracket including a ramp leading to a pin receptacle; and a first pin assembly disposed in the bottom corner of the second side of the gate frame, the first pin assembly including a downwardly-biased vertical pin; a second pin assembly disposed in the top corner of the second side of the gate frame, the second pin assembly including an upwardly-biased vertical pin; wherein the gate frame may be rotatably adjusted, relative to the stationary frame assembly, from a first position to a second position, wherein in the first position the downwardly-biased pin is in contact with the first sill bracket ramp and the upwardly-biased pin is in contact with the second sill bracket ramp, wherein in the second position the downwardly-biased pin is seated within the first sill bracket pin receptacle and the upwardly-biased pin is seated within the second sill bracket pin receptacle, and wherein movement of the gate frame from the first position to the second position causes the respective pins to be temporarily vertically deflected by the respective ramps.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
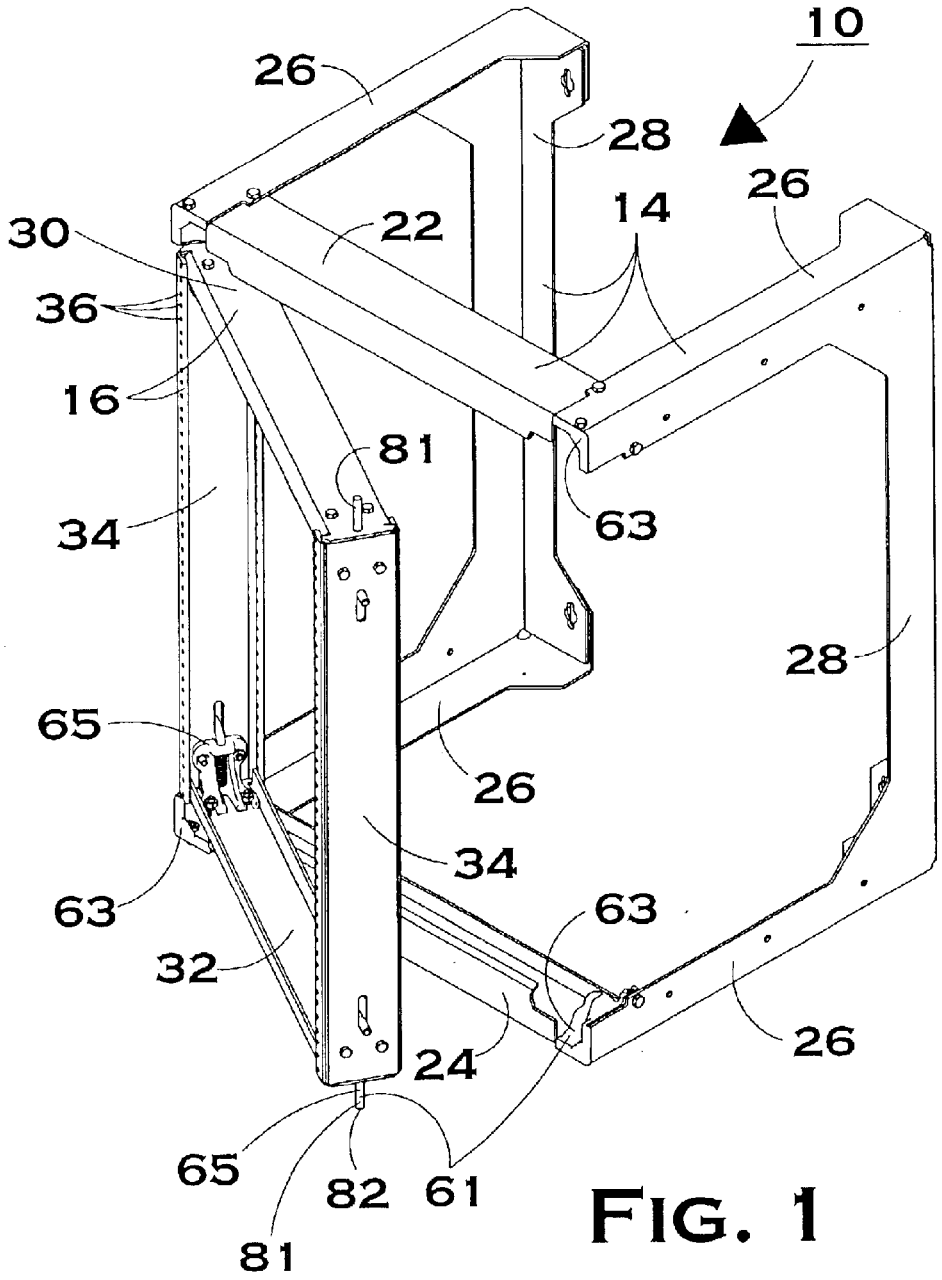
FIG. 1 is a perspective view of a wall-mounted rack using a ramped latch closure system in accordance with the present invention.

FIG. 1 shows a wall-mounted rack 10 utilizing a ramped latch closure system 61 in accordance with the preferred embodiments of the present invention. The rack 10 shown is of the well-known swing-gate type and includes a stationary frame assembly 14 attachable to a wall and a pivoting gate frame 16 mounted thereon. The stationary frame assembly 14 includes a top front member 22, a bottom front member 24, four side horizontal members 26 and a pair of back members 28. The gate frame 16 includes a top member 30, a bottom member 32, and a pair of side members 34. Each side member 34 is formed with mounting apertures 36 regularly spaced along its front and rear surfaces, thus permitting electronic components and accessories to be mounted thereon. Some or all of the various members of the stationary frame assembly 14 and of the gate frame 16 may be integrally formed, or they may be fastened together via well-known means.

The rack 10 further utilizes a ramped latch closure system 61 for pivotably attaching the gate frame 16 to the stationary frame assembly 14. In the preferred embodiment, the ramped latch closure system 61 includes at least one pair, and preferably two pairs, of ramped sill brackets 63 in combination with the same number of pin assemblies 65. Ramped sill brackets 63 are mounted in the upper and lower corners on at least one side, and preferably both sides, of the frame assembly 14. However, it should be understood that a single ramped sill bracket 63 in combination with a single pin assembly 65 may be used for certain applications.

Figure 2:
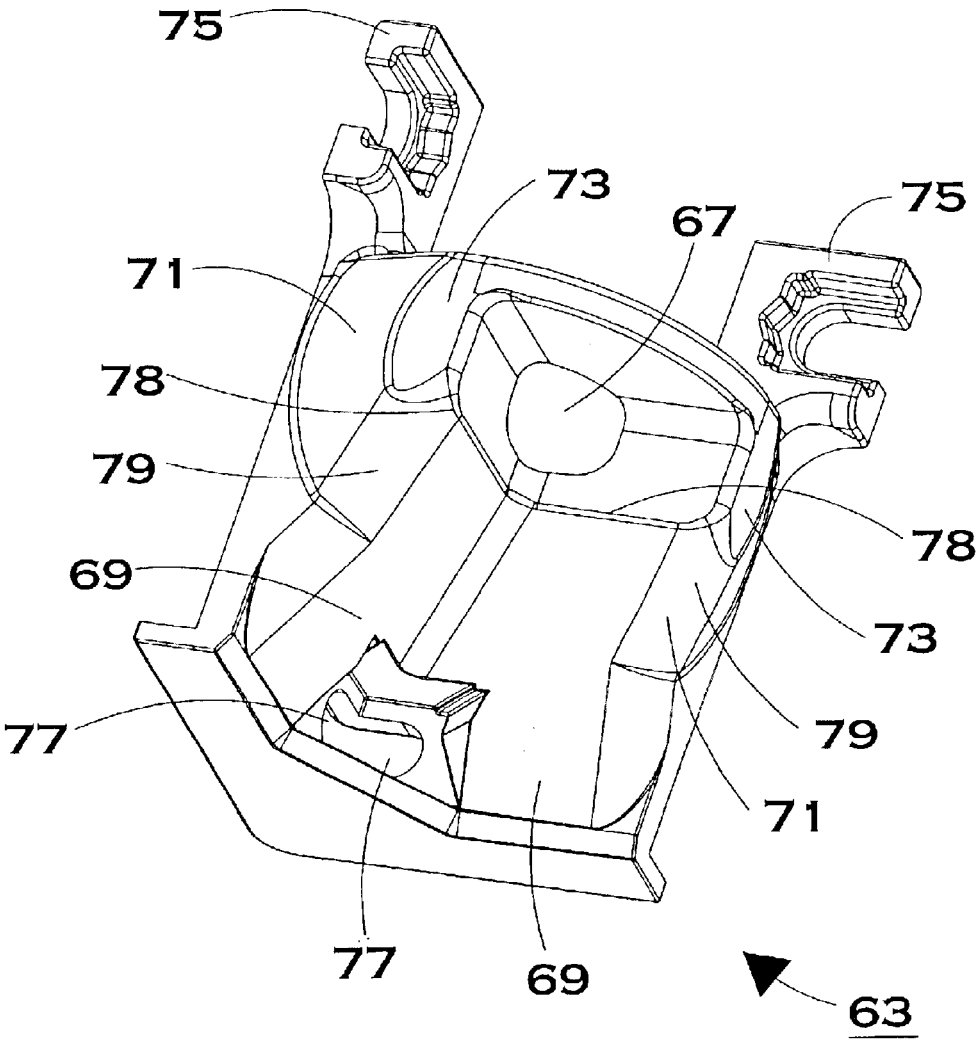
FIG. 2 is a perspective view of one of the ramped sill brackets of FIG. 1 shown in a lower left orientation.

FIG. 2 is a perspective view of one of the ramped sill brackets 63 of FIG. 1 shown in the lower left orientation. Each ramped sill bracket 63 includes a pin receptacle 67, a pair of planar ramps 69, a pair of semi-conical ramps 71, a pair of bearing surfaces 73, a pair of distal mounting flanges 75, and a pair of interconnected mounting slots 77. Each planar ramp 69 is separated from the pin receptacle 67 by a respective rearward edge 78, and each of the semi-conical ramps 71 further includes a leading surface 79 for a purpose to be explained below. In order to provide sufficient support for heavy-duty applications, each sill bracket 63 may be cast from a suitable metal, but it should be understood that other production methods and materials may be appropriate, depending on the application for the still bracket 63, without departing from the scope of the present invention.

Preferably, the ramped sill bracket 63 is diagonally symmetrical, so that each planar ramp 69, semi-conical ramp 71, bearing surface 73, mounting flange 75 and mounting slot 77 is disposed opposite a corresponding planar ramp 69, semi-conical ramp 71, bearing surface 73, mounting flange 75 and mounting slot 77, respectively, along a diagonal line or plane of symmetry. Similarly, the pin receptacle 67 is also diagonally symmetrical. This symmetry permits each bracket 63 to be used in either a left-hand or right-hand corner merely by rotating the bracket 63 by 90 degrees. It should be understood by those of ordinary skill in the art, however, that the single pin receptacle 67 may be replaced by a pair of perpendicularly disposed pin receptacles (not shown), that the interconnected mounting slots 77 may be replaced by two separate mounting slots (not shown), and that the mounting slots 77 and mounting flanges 75 in general may be replaced by other mounting means without affecting the symmetry of the other features and without departing from the scope of the present invention.

Figure 3:
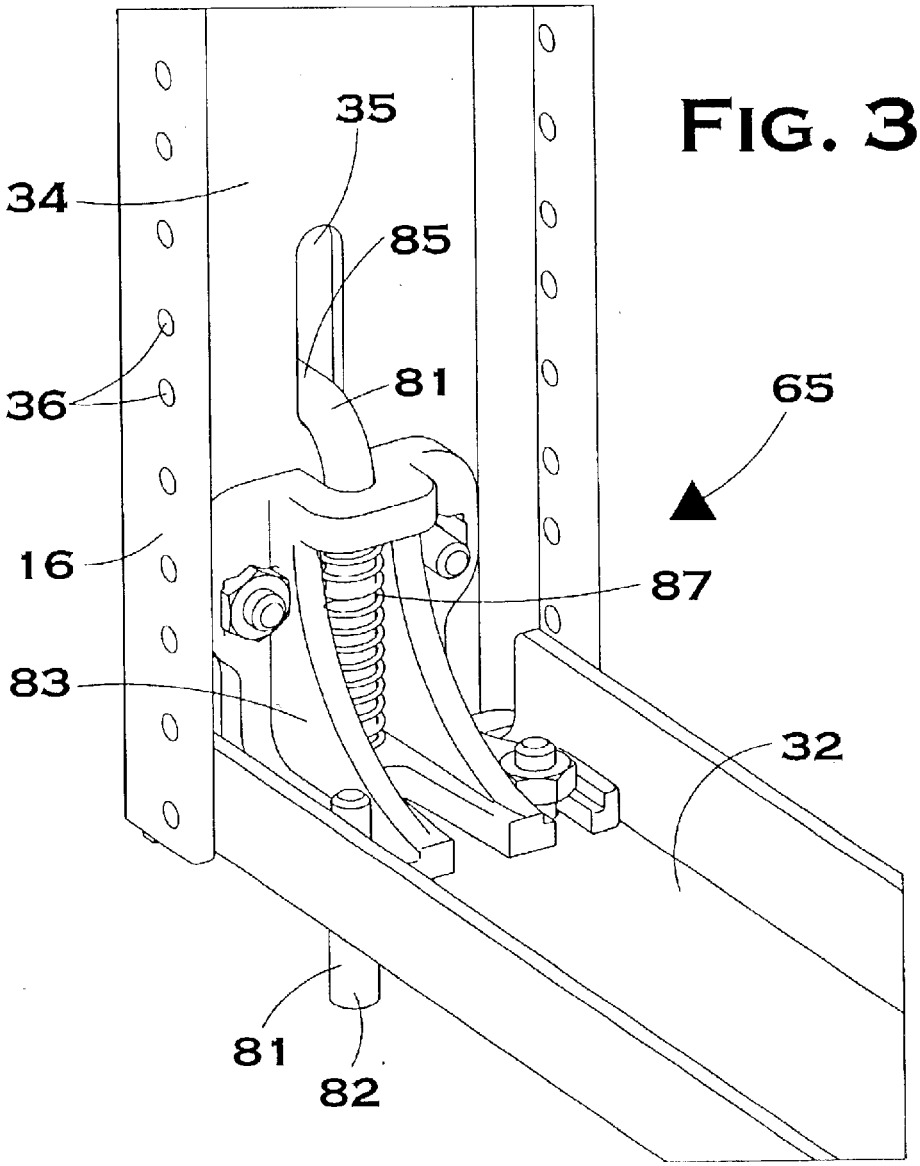
FIG. 3 is a perspective view of one of the pin assemblies of FIG. 1 shown in the lower left orientation.

FIG. 3 is a perspective view of one of the pin assemblies 65 of FIG. 1 shown in the lower left orientation. Each pin assembly 65 includes a spring-loaded retractable pin 81 retained within a corner bracket 83 which is mounted in a corner of the gate frame 16. As shown, the retractable pin 81 is an L-shaped rod of cylindrical cross-section which extends through corresponding openings 33, 35 in both the top or bottom member 30, 32 and the side member 34 adjacent to the corner bracket 83. The end of the pin 81 extending through the side member 34 of the gate frame 16 may be used as a handle 85 for adjusting the vertical position of the retractable pin 81, and the opening 35 in the side member is preferably in the form of a vertical slot so that the handle 85 may be moved freely up and down. The pin 81 is normally biased by the spring 87 in the extended position. When the handle 85 is adjusted vertically within the slot 35, the pin 81 may be retracted into the gate frame 16. However, it should be understood that pins having differing constructions and methods of operation may likewise be used without departing from the scope of the present invention.

Each ramped sill bracket 63 and corresponding pin assembly 65 is disposed such that when the gate frame 16 is positioned between the top and bottom front members 22, 24 of the stationary frame assembly 14, each pin 81 is aligned with the pin receptacle 67 on the corresponding ramped sill bracket 63. As best understood from FIGS. 2 and 5, the ramped sill bracket 63 may be attached to the stationary frame assembly 14 by inserting suitable fasteners 76 through apertures in members of the stationary frame assembly 14 and through the two mounting flanges 75 and at least one of the mounting slots 77. Likewise, as illustrated in FIG. 3, the pin assembly 65 may be attached to the gate frame 16 by inserting suitable fasteners through apertures in members of the gate frame 16 and through corresponding slots and openings in the corner bracket 83 of the pin assembly 65.

Figure 4:
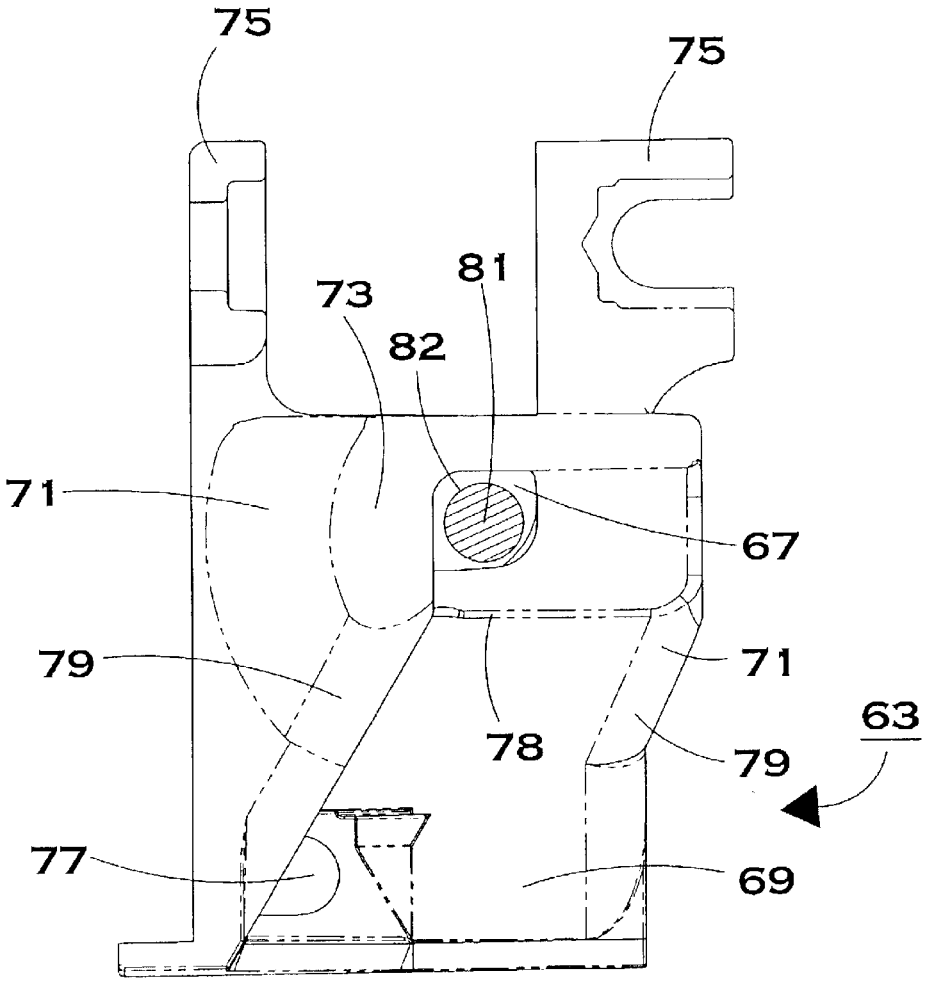
FIG. 4 is a top plan view of the ramped sill bracket of FIG. 2 showing a pin residing in the pin receptacle.

FIG. 4 is a top plan view of the ramped sill bracket 63 of FIG. 2 showing a pin 81 residing in the pin receptacle 67. The pin receptacle 67 is a recess of suitable size and shape to snugly receive the end 82 of the pin therein. Significantly, the pin receptacle 67 is diagonally symmetrical such that the pin receptacle 67 is also capable of receiving a pin 81 therein when the pin receptacle 67 is rotated 90 degrees. When two pin assemblies 65 and ramped sill brackets 63 are disposed along one side of the gate frame 16 and stationary frame assembly 14, the gate frame 16 may then be rotated open relative to the front of the stationary frame assembly 14 by pivoting the gate frame 16 upon its pins 81 within their corresponding pin receptacles 67.

The combination of the ramped sill bracket 63 and corresponding pin assembly 65 may also be used as a latch. In use, the pin 81 may be removed from the pin receptacle 67 by exerting sufficient force on the handle 85 to retract the pin 81 into the gate frame 16. The corner of the gate frame 16 is then free to move from its position in the stationary frame assembly 14. It should be obvious, however, that if ramped sill brackets 63 and pin assemblies 65 are used in pairs, it may be necessary to remove both the upper and lower pins 81 from their respective receptacles 67 in the manner described above. In either case, whenever the pin or pins 81 on one side of the gate frame 16 have been retracted, the gate frame 16 may be removed from its position between the top and bottom front members 22, 24 of the stationary frame assembly 14. Once the gate frame 16 has been opened, the respective pin handles 85 may be released, allowing the respective pins 81 to return to their extended positions. The gate frame 16 may then be rotated to a desired position as shown in FIG. 1.

Figure 5:
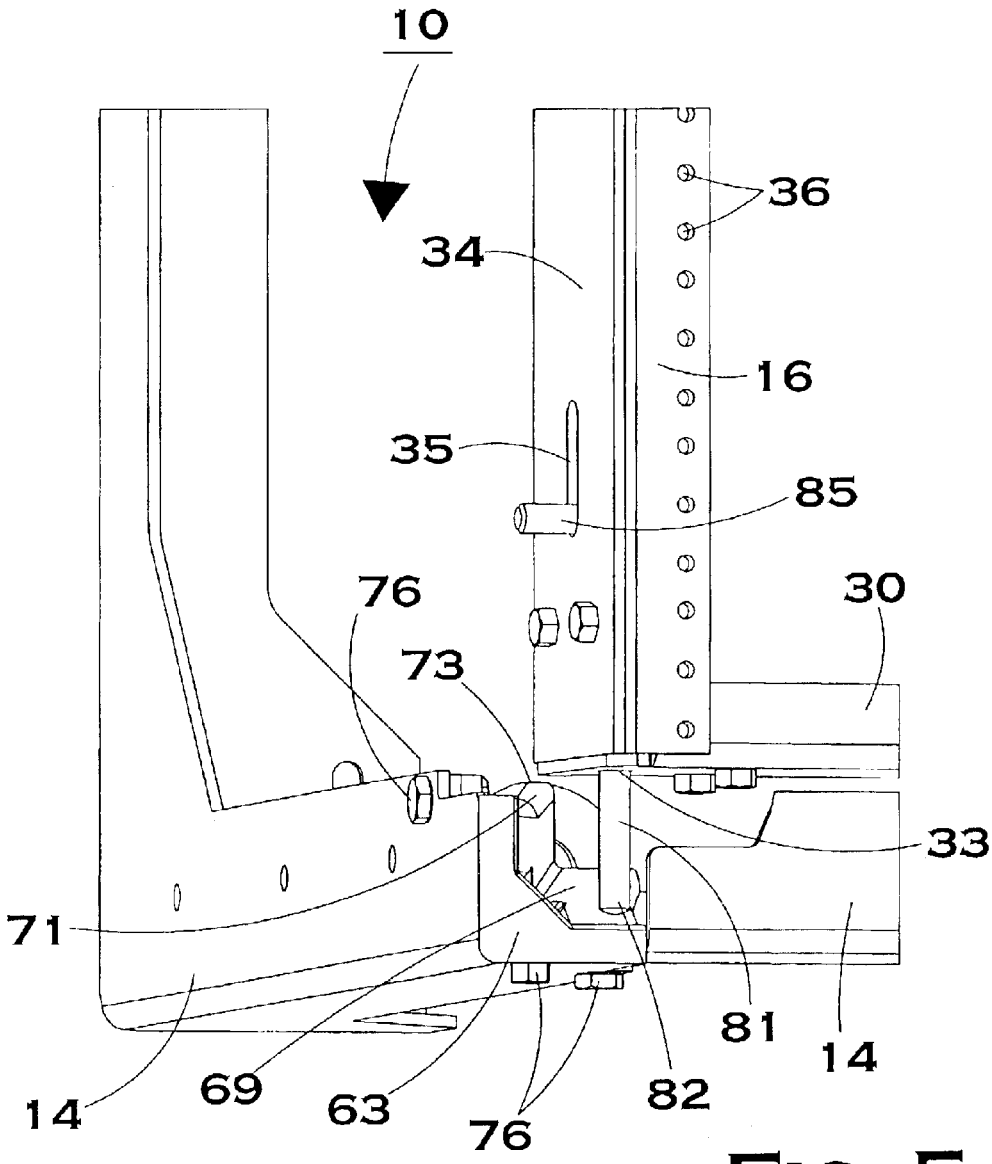
FIG. 5 is a partial perspective view of a portion of the rack of FIG. 1 with the left side of the gate frame shown in a nearly-closed position.

If the gate frame 16 is to be returned to its closed position within the stationary frame assembly 14, the gate frame 16 may be pivoted such that the pins 81 are rotated back toward their corresponding ramped sill brackets 63. FIG. 5 is a partial perspective view of a portion of the rack of FIG. 1 with the left side of the gate frame 16 shown in a nearly-closed position. As the pin 81 reaches the ramped sill bracket 63, as shown in FIG. 5, the end 82 of the pin 81 makes contact with one of the planar ramps 69. As the gate frame 16 is pivoted further, the incline of the planar ramp 69 forces the pin 81 to gradually retract into the gate frame 16. As the gate frame 16 is pivoted still further, the bottom edge of the gate frame 16 makes contact with the semi-conical ramp 71 on the diagonally opposite side of the ramped sill bracket 63 from the planar ramp 69. Although not illustrated, this same process may likewise be carried out with regard to the top edge of the gate frame 16 and a top-mounted ramped latch closure system 61. In either case, the incline of the semi-conical ramp 71 gradually guides the gate frame 16 into position in the stationary frame assembly 14. When the pin 81 passes the rearward edge 78 of the planar ramp 69 and contacts the bearing surface 73, the pin 81 is maximally retracted within the gate frame 16 until the pin 81 reaches the pin receptacle 67, at which point the spring-loaded pin 81 is biased into the pin receptacle 67 and retained therein. It should be apparent that the gate frame 16 may thus be closed and latched merely by rotating the gate frame 16 toward the stationary frame assembly 14 with sufficient force to cause the pins 81 to be retracted into the gate frame 16 by the respective planar ramps 69 and to properly position the gate frame 16 within the stationary frame assembly 14. No further manual intervention is then necessary.

Figure 6:
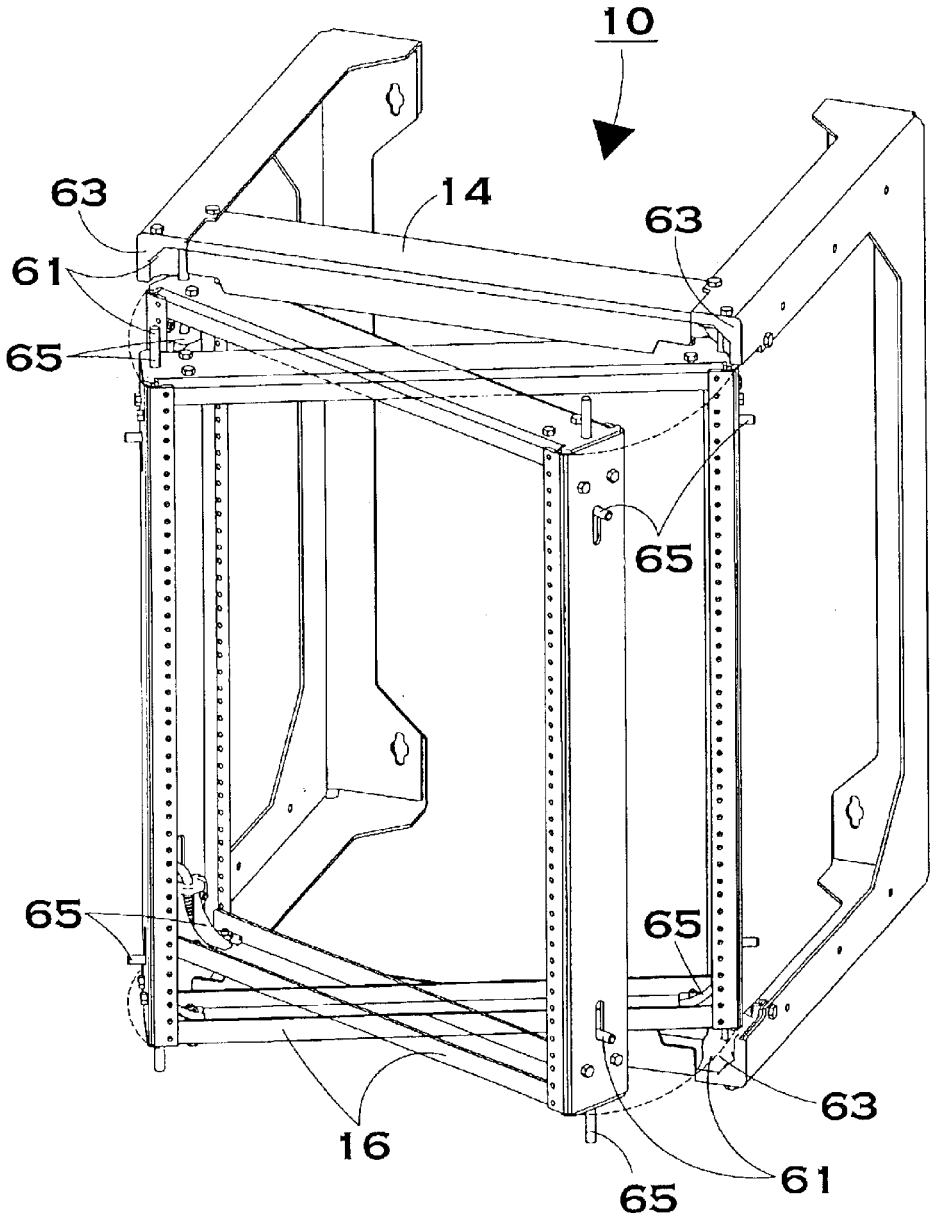
FIG. 6 is a perspective view of the rack of FIG. 1 illustrating the use of the ramped latch closure system as either a hinge or a latch.

FIG. 6 is a perspective view of the rack 10 of FIG. 1 illustrating the use of the ramped latch closure system 61 as either a hinge or a latch. When ramped sill brackets 63 and pin assemblies 65 are utilized along both sides of the gate frame 16, the gate frame 16 may be hinged open along either side thereof, with the opposite side being latched and unlatched as described hereinabove. Thus, when provided with one or more ramped sill brackets 63 and pin assemblies 65 on each side of a frame, door, cover or the like, the present invention thus facilitates easy opening and closing of frames and other objects from either side thereof.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A rack for supporting electrical equipment, the rack comprising:

a stationary frame assembly having a front, a rear, a first side and a second side;

a hinge assembly;

a gate frame having a front, a rear, a first side and a second side, the first gate frame side being rotatably attached to the first side of the stationary frame assembly via the hinge assembly; and a sill bracket disposed in a corner of the second side of the stationary frame assembly, the sill bracket including a ramp leading to a pin receptacle.

2. The rack of claim 1, further comprising a pin assembly disposed on the gate frame.

3. The rack of claim 2, wherein the pin assembly includes a pin adapted to be received by the pin receptacle.

4. The rack of claim 3, wherein the pin assembly includes a spring for biasing the pin toward the pin receptacle.

5. The rack of claim 3, wherein the pin extends in a vertical direction, and wherein the pin receptacle is oriented to receive a vertically-oriented pin.

6. The rack of claim 3, wherein the gate frame is rotatably adjustable between at least two positions, the two positions including:

a first position in which the pin is in contact with the ramp; and a second position in which the pin is seated within the pin receptacle.

7. The rack of claim 6, wherein the gate frame is rotatably adjustable between the first position and the second position without direct manual interaction with the pin.

8. The rack of claim 6, wherein movement of the gate frame from the first position to the second position causes the pin to be temporarily vertically deflected by the ramp.

9. The rack of claim 1, wherein the sill bracket includes at least a first portion and a second portion, and wherein the first portion is diagonally symmetrical to the second portion.

10. The rack of claim 9, wherein the first portion of the sill bracket includes a first part of the pin receptacle, and wherein the second portion of the sill bracket includes a second part of the pin receptacle.

11. A rack for supporting electrical equipment, the rack comprising:

a stationary frame assembly having a front, a rear, a first side and a second side;

a hinge assembly;

a gate frame having a front, a rear, a first side and a second side, the first gate frame side being rotatable attached to the first side of the stationary frame assembly via the hinge assembly; and a sill bracket disposed in the lower corner of the second side of the stationary frame assembly, the sill bracket including a ramp leading to a pin receptacle, and further comprising a second sill bracket disposed in the upper corner of the second side of the stationary frame assembly.

12. The rack of claim 11, wherein the sill brackets are of identical construction and wherein, in their installed positions, one sill bracket is rotated 90 degrees relative to the other one.

13. A rack for supporting electrical equipment, the rack comprising:

a stationary frame assembly having a front, a rear, a first side and a second side;

a hinge assembly;

a gate frame having a front, a rear, a first side and a second side, the first gate frame side being rotatably attached to the first side of the stationary frame assembly via the hinge assembly; and a sill bracket disposed in a corner of the second side of one of the gate frame and the stationary frame assembly, the sill bracket including a first ramp leading to a pin receptacle, wherein the sill bracket includes at least a first portion and a second portion, wherein the first portion is diagonally symmetrical to the second portion, wherein the first ramp is part of the first portion of the sill bracket, wherein the second portion of the sill bracket includes a second ramp, and wherein the first ramp and the second ramp are diagonally symmetrical.

14. A rack for supporting electrical equipment, the rack comprising:

a stationary frame assembly having a front, a rear, a first side and a second side;

a hinge assembly;

a gate frame having a front, a rear, a first side and a second side, the first gate frame side being rotatable attached to the first side of the stationary frame assembly via the hinge assembly; and a sill bracket disposed in a corner of the second side of one of the gate frame and the stationary frame assembly, the sill bracket including a ramp leading to a pin receptacle;

wherein the stationary frame assembly includes at least one side member and at least one bottom member, wherein the side member is disposed on the second side of the stationary frame assembly, and wherein the sill bracket is attached to both the side member and the bottom member.

15. A rack for supporting electrical equipment, the rack comprising:

a stationary frame assembly having a front, a rear, a first side and a second side;

a hinge assembly;

a gate frame having a front, a rear, a first side and a second side, the first gate frame side being rotatably attached to the first side of the stationary frame assembly via the hinge assembly; and a sill bracket disposed in a corner of the second side of one of the gate frame and the stationary frame assembly, the sill bracket including a ramp leading to a pin receptacle;

wherein the gate frame includes at least one side member and at least one bottom member, wherein the side member is disposed on the second side of the gate frame, and wherein the sill bracket is attached to both the side member and the bottom member.

16. A rack for supporting electrical equipment, the rack comprising:

a stationary frame assembly having a front, a rear, a first side and a second side;

a hinge assembly;

a gate frame having a front, a rear, a first side and a second side, the first gate frame side being rotatably attached to the first side of the stationary frame assembly via the hinge assembly;

a sill bracket disposed in a corner of the second side of one of the gate frame and the stationary frame assembly, the sill bracket including a ramp leading to a pin receptacle; and a pin assembly including a pin adapted to be received by the pin receptacle, wherein if the sill bracket is disposed in the gate frame, then the pin assembly is disposed on the stationary frame assembly, and if the sill bracket is disposed in the stationary frame assembly, then the pin assembly is disposed on the gate frame, wherein the sill bracket is a first sill bracket and the pin assembly is a first pin assembly, wherein the hinge assembly includes a second sill bracket and a second pin assembly, wherein the second sill bracket includes a ramp leading to a pin receptacle, and wherein the second pin assembly includes a pin adapted to be received by the pin receptacle.

17. The rack of claim 16, wherein when the pin of the first pin assembly is disposed within the pin receptacle of the first sill bracket, then the gate frame may be rotated relative to the stationary frame assembly via the first pin assembly and first sill bracket.

18. The rack of claim 17, wherein the first sill bracket and the first pin assembly are identical to the second sill bracket and the second pin assembly, respectively.

19. A method for latching a first structure to a second structure in an electrical equipment rack, wherein at least one of the structures is a gate frame, wherein the first and second structures are initially hinged together, and wherein a pin is disposed on the first structure, the first structure being the gate frame, and a ramped sill bracket having an inclined ramp and a pin receptacle is disposed on the second structure, the method comprising the steps of:

rotating at least one of the two structures toward the other structure;

during the rotating step, displacing the pin using the inclined ramp; and discontinuing the rotating step once the pin enters the pin receptacle.

20. The method of claim 19, wherein the step of displacing the pin includes displacing the pin in a vertical direction.

21. The method of claim 20 further including the step of biasing the pin in a direction opposite that of the displacement of the pin.

22. The method of claim 21, wherein the step of biasing the pin is carried out by a spring.

23. A method for latching a first structure to a second structure in an electrical equipment rack, wherein at least one of the structures is a gate frame, wherein the first and second structures are initially hinged together, and wherein a first pin is disposed on the first structure and a ramped sill bracket having a first inclined ramp and a first pin receptacle is disposed on the second structure, wherein a second pin is disposed on one of the two structures and a second ramped sill bracket having second inclined ramp and a pin receptacle is disposed on the other of the two structures, wherein the method comprises:

rotating at least one of the two structures toward the other structure;

during the rotating step, displacing the first pin using the first inclined ramp;

discontinuing the rotating step once the first pin enters the first pin receptacle;

causing the second pin to be displaced by the second inclined ramp during the rotating step; and discontinuing the rotating step once each of the pins has entered its respective pin receptacle.

24. A method for latching a first structure to a second structure in an electrical equipment rack, wherein at least one of the structures is a gate frame, wherein the first and second structures are initially hinged together, and wherein a pin is disposed on the first structure and a ramped sill bracket having a first inclined ramp, a second ramp, and a pin receptacle is disposed on the second structure, wherein the method comprises:

rotating at least one of the two structures toward the other structure;

during the rotating step, displacing the pin using the inclined ramp;

discontinuing the rotating step once the pin enters the pin receptacle; and contacting the first structure with the second ramp in order to guide the first and second structures together.

25. The method of claim 24, wherein the ramped sill bracket further includes a bearing surface disposed adjacent an end of the second ramp, and wherein the method further comprises the step of positioning the first structure relative to the second structure using the bearing surface.

26. The method of claim 25, further comprising the step of guiding the first structure into contact with the bearing surface using the second ramp.

27. The method of claim 19, wherein the rotating step is initiated by a user, and wherein the step of displacing the pin occurs without direct interaction between the user and the pin.

28. A ramped latch closure system for securing a first structure to a second structure, the ramped latch closure system comprising:

a pin receptacle having an opening disposed at least partially at a first elevation for vertically receiving a pin;

a first ramp vertically inclined toward the pin receptacle for gradually guiding a pin toward the pin receptacle, the first ramp extending from a second elevation to a third elevation, the portion of the first ramp disposed at the second elevation being generally adjacent the pin receptacle opening; and a second ramp extending from a fourth elevation to a fifth elevation, wherein at least one of the fourth and fifth elevations is separated from the first elevation in one vertical direction and wherein the third elevation is separated from the first elevation in the opposite vertical direction.

29. The ramped latch closure system of claim 28, wherein the fourth elevation is above the first elevation and the third elevation is below the first elevation.

30. The ramped latch closure system of claim 29, further comprising a bearing surface disposed at the fourth elevation.

31. The ramped latch closure system of claim 30, wherein the second ramp is vertically inclined toward the bearing surface.

32. The ramped latch closure system of claim 29, wherein the fifth elevation is above the first elevation.

33. The ramped latch closure system of claim 28, wherein at least one fourth of the pin receptacle opening lies in a horizontal plane.

34. The ramped latch closure system of claim 28, wherein the second ramp is generally semi-conical in shape.

35. The ramped latch closure system of claim 34, wherein the first ramp is generally planar in shape.

36. The ramped latch closure system of claim 28, wherein the slope of the first ramp is substantially equal to the slope of the second ramp.

37. The ramped latch closure system of claim 28, further comprising a third ramp, the first and third ramps being diagonally symmetrical.

38. The ramped latch closure system of claim 37, further comprising a fourth ramp, the second and fourth ramps being diagonally symmetrical.

39. The ramped latch closure system of claim 28, further comprising a pin assembly.

40. The ramped latch closure system of claim 39, wherein the pin assembly includes a pin of suitable size and shape for vertical insertion into the pin receptacle.

41. The ramped latch closure system of claim 40, wherein the pin is vertically adjustable relative to the first ramp.

42. The ramped latch closure system of claim 40, wherein the pin is disposed to contact the first ramp when the pin assembly and the first ramp are moved toward each other.

43. A rack for supporting electrical components, the rack comprising:

a stationary frame assembly having a front, a rear, a first side and a second side, the second side having a top corner and a bottom corner;

a gate frame having a front, a rear, a first side and a second side, the first side of the gate frame being rotatably attached to the first side of the stationary frame assembly, and the second side of the gate frame having a top corner and a bottom corner;

a first sill bracket disposed in the bottom corner of the second side of the stationary frame assembly, the sill bracket including a ramp leading to a pin receptacle;

a second sill bracket disposed in the top corner of the second side of the stationary frame assembly, the sill bracket including a ramp leading to a pin receptacle;

a first pin assembly disposed in the bottom corner of the second side of the gate frame, the first pin assembly including a downwardly-biased vertical pin;

a second pin assembly disposed in the top corner of the second side of the gate frame, the second pin assembly including an upwardly-biased vertical pin;

wherein the gate frame may be rotatably adjusted, relative to the stationary frame assembly, from a first position to a second position, wherein in the first position the downwardly-biased pin is in contact with the first sill bracket ramp and the upwardly-biased pin is in contact with the second sill bracket ramp, wherein in the second position the downwardly-biased pin is seated within the first sill bracket pin receptacle and the upwardly-biased pin is seated within the second sill bracket pin receptacle, and wherein movement of the gate frame from the first position to the second position causes the respective pins to be temporarily vertically deflected by the respective ramps.

* * * * *